US008622480B2

(12) United States Patent
Weckerly et al.

(10) Patent No.: US 8,622,480 B2
(45) Date of Patent: Jan. 7, 2014

(54) MACHINE WITH PIVOTAL CONNECTION BETWEEN A FRAME AND A CONVEYOR

(75) Inventors: Jordan Dorian Weckerly, Maple Grove, MN (US); Michael Edwin Stevens, Saint Paul, MN (US); Lucian Mihai Husar, Rogers, MN (US); John Eron Jorgensen, Andover, MN (US)

(73) Assignee: Caterpillar Inc., Peoria, IL (US)

( * ) Notice: Subject to any disclaimer, the term of this patent is extended or adjusted under 35 U.S.C. 154(b) by 161 days.

(21) Appl. No.: 13/250,850

(22) Filed: Sep. 30, 2011

(65) Prior Publication Data

US 2013/0082511 A1 Apr. 4, 2013

(51) Int. Cl.
*E01C 23/12* (2006.01)

(52) U.S. Cl.
USPC ..... 299/39.2; 198/313

(58) Field of Classification Search
USPC ..... 198/313, 315, 318, 861.5; 403/161–165; 299/39.2
See application file for complete search history.

(56) References Cited

U.S. PATENT DOCUMENTS

| | | | | |
|---|---|---|---|---|
| 2,561,997 | A * | 7/1951 | Smith | 198/861.5 |
| 3,049,817 | A * | 8/1962 | MacDonald | 37/381 |
| 3,591,935 | A * | 7/1971 | Bremmer et al. | 37/407 |
| 4,037,981 | A * | 7/1977 | Wirtgen | 299/39.2 |
| 4,325,580 | A | 4/1982 | Swisher, Jr. et al. | |
| 4,834,463 | A * | 5/1989 | Nye | 299/39.2 |
| 5,178,253 | A | 1/1993 | Fix | |
| 5,441,361 | A * | 8/1995 | Campbell | 404/90 |
| 7,527,279 | B1 | 5/2009 | McCalip | |
| 2005/0269114 | A1 * | 12/2005 | Turgeon | 172/677 |

FOREIGN PATENT DOCUMENTS

| | | |
|---|---|---|
| JP | 02100402 | 8/1990 |
| KR | 1020090114311 | 11/2009 |

OTHER PUBLICATIONS

"PM-200 Cold Planer," Caterpillar Inc., 2005, 16 pages.
"Technical specification: Cold Milling Machine W 200," Wirtgen Group, Mar. 2010, 8 pages.
"Technical specification: Cold Milling Machine W 210/W 210i," Wirtgen Group, Aug. 2011, 8 pages.
"Technical specification: Cold Milling Machine W 2100," Wirtgen Group, Mar. 2011, 8 pages.
"Technical specification: Cold Milling Machine W 2200," Wirtgen Group, Aug. 2009, 8 pages.

* cited by examiner

*Primary Examiner* — John Kreck
(74) *Attorney, Agent, or Firm* — Finnegan, Henderson, Farabow, Garrett & Dunner LLP

(57) ABSTRACT

A machine configured to travel across a surface is disclosed. A material removal mechanism is configured to remove material from the surface. A frame supports the material removal mechanism. A conveyor is configured to receive the material and to convey the material to a location off of the machine. A pivotal connection includes connectors connected to the frame and conveyor, respectively, which are configured to mate with one another to allow pivoting of the conveyor relative to the frame.

15 Claims, 2 Drawing Sheets

MACHINE WITH PIVOTAL CONNECTION BETWEEN A FRAME AND A CONVEYOR

TECHNICAL FIELD

The disclosure relates generally to a machine and, more particularly, to a machine with a pivotal connection between a frame and a conveyor.

BACKGROUND

Many machines are mobile machines configured to perform one or more tasks while traveling along a ground surface, such as a road surface. A cold planer is an example of such a mobile machine. The cold planer may include a grinding mechanism that grinds a top layer of the road surface. The cold planer may include a conveyor, connected to a frame of the machine, which receives the material that was removed from the road surface. The conveyor may convey the material to another vehicle, such as a dump truck, traveling next to the cold planer. The conveyor may be rotated relative to the machine frame, such that the conveyor is positioned to deposit the material into the dump truck, for example.

U.S. Pat. No. 4,325,580 to Swisher, Jr. et al. (referred to as the Swisher patent), which issued on Apr. 20, 1982, discloses a conventional cold planer. An upper material lifting conveyor is connected to a main frame of the planer. Specifically, the conveyor includes an upper lug and a lower lug that are pivotally engaged, via a pair of conventional mounting pins, with a pair of corresponding lugs of the main frame. This arrangement allows the conveyor to rotate relative to the main frame.

The Swisher patent suffers from numerous disadvantages. Specifically, the upper lifting conveyor is relatively heavy and long. Thus it is awkward to precisely align the conveyor relative to the main frame so that the mounting pins may be disposed through the holes in the lugs to connect the conveyor to the frame. For example, if the conveyor is positioned such that the holes in the upper and lower lugs are rotated even slightly relative to holes in the lugs of the frame, it may be impossible to insert the mounting pins through the lug holes. Specialized tooling is often required to first hold the conveyor, and then to precisely locate and orient the conveyor relative to the main frame. This tooling may be expensive, may not be readily available, and may require a long time to set up and adjust.

The disclosed machine is directed to overcoming one or more of the problems set forth above and/or other problems of the prior art.

SUMMARY

The disclosure provides a machine configured to travel across a surface. A material removal mechanism is configured to remove material from the surface. A frame supports the material removal mechanism. A conveyor is configured to receive the material and to convey the material to a location off of the machine. A pivotal connection includes connectors connected to the frame and conveyor, respectively, which are configured to mate with one another to allow pivoting of the conveyor relative to the frame.

The disclosure further provides a cold planer configured to remove material from a surface of a roadway. A material removal mechanism is configured to remove material from the surface. A frame supports the material removal mechanism. A conveyor is configured to receive the material and to convey the material to a location off of the cold planer. A pivotal connection includes a frame-side structure and a conveyor-side structure. The frame-side structure includes at least one protrusion that extends from at least one frame-side flange connected to the frame. The conveyor-side structure includes at least one opening formed in at least one conveyor-side flange connected to the conveyor. The at least one protrusion is configured to mate with the at least one opening to allow pivoting of the conveyor relative to the frame.

The disclosure still further provides a cold planer configured to remove material from a surface of a roadway. A material removal mechanism includes a grinding mechanism configured to remove material from the surface of the roadway. A lower conveyor is located adjacent the material removal mechanism and is configured to receive the material removed from the surface of the roadway by the material removal mechanism. A frame supports the material removal mechanism and the lower conveyor. An upper conveyor is configured to receive the material from the lower conveyor and to further convey the material to a location off of the cold planer. A pivotal connection includes a first structure and a second structure. The first structure includes first and second flanges connected to one of the frame and the upper conveyor. The first structure also includes first and second protrusions that extend from top surfaces of the first and second flanges, respectively. The second structure includes third and fourth flanges connected to the other one of the frame and the upper conveyor. The second structure also includes first and second openings formed in the third and fourth flanges, respectively. The first and second protrusions are configured to mate with the first and second openings, respectively, to allow pivoting of the conveyor relative to the frame. The first and second openings have diameters that are approximately ½ to 1" larger than corresponding diameters of the first and second protrusions, respectively.

DETAILED DESCRIPTION

Figure 1:
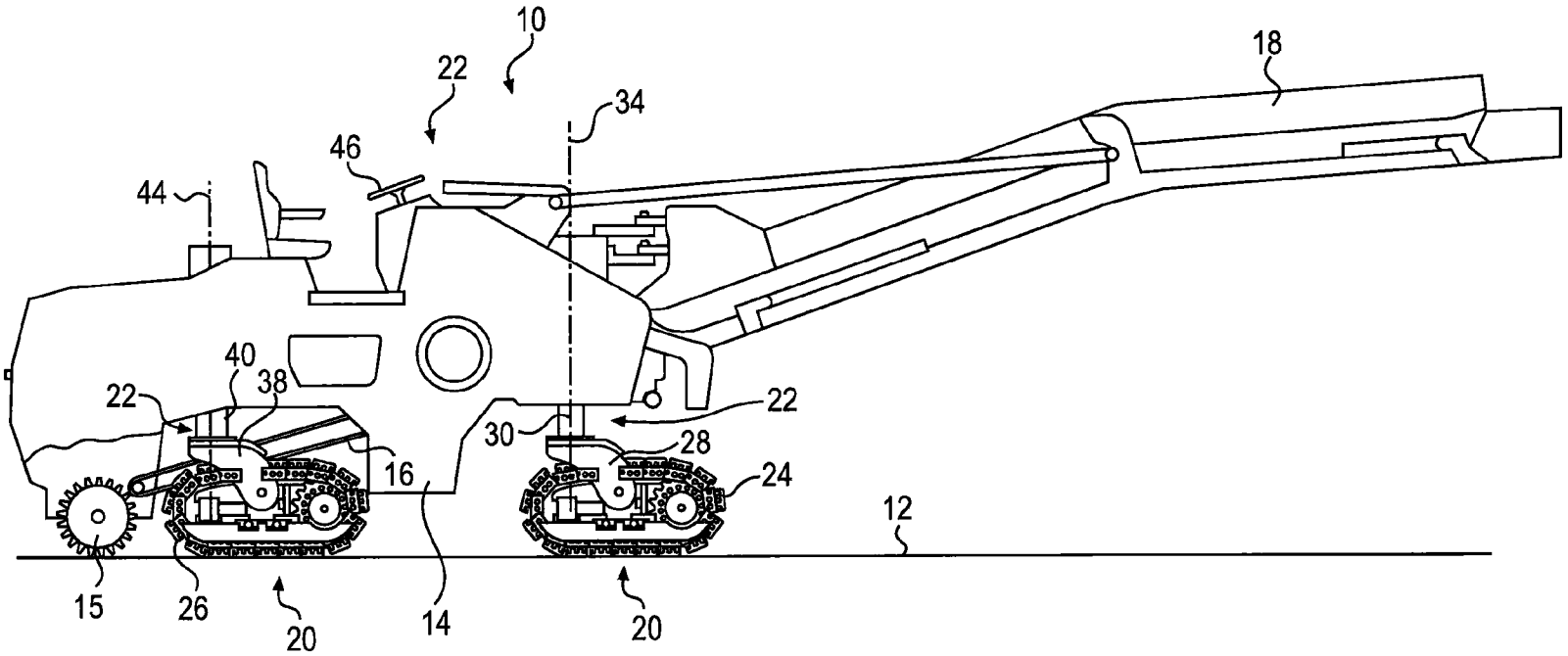
FIG. 1 is a side view pictorial illustration of a machine having an exemplary disclosed pivotal connection between a frame and a conveyor.

FIG. 1 illustrates an embodiment of a machine 10 in accordance with the present disclosure. Machine 10 may be a mobile machine operable to move along a ground surface 12 that is underneath machine 10. Ground surface 12 may be a man-made surface, such as a road, parking lot, concrete cement, or other paved surface.

Machine 10 may be configured to perform various functions when traveling over ground surface 12. In the embodiment shown in FIG. 1, machine 10 is a cold planer. In such an embodiment, machine 10 may be configured to cut or grind a top layer of concrete, asphalt, or similar material, to a depth that is typically between 1" to 14" below ground surface 12.

Machine 10 may include a frame 14. Frame 14 may serve to tie together and support other components and systems of machine 10. In addition to frame 14, machine 10 may have various other components and systems that serve various purposes. In the embodiment where machine 10 is a cold planer, frame 14 may support a material removal mechanism 15 that is configured to cut or grind the top layer of ground surface 12. In the embodiment shown in FIG. 1, material removal mechanism 15 is a grinding mechanism that includes a rotor with a plurality of teeth configured to grind ground surface 12. However, material removal mechanism 15 is not limited to such an arrangement. Although FIG. 1 shows material removal mechanism 15 housed in a central, lower portion of machine 10, material removal mechanism 15 may be disposed in various places on machine 10. Alternatively or additionally, machine 10 may include one or more supplementary grinding mechanisms that are located in rear and/or forward positions in machine 10.

Frame 14 may support a lower conveyor 16 that is located adjacent material removal mechanism 15 and configured to receive the material removed from ground surface 12 by material removal mechanism 15. Frame 14 may also support an upper conveyor 18 configured to receive the material from lower conveyor 16 and to further convey the material to a location off of machine 10, such as to a receiver (e.g., another truck separate from machine 10). For example, the truck may be a dump truck that includes a box. The dump truck may drive next to machine 10 during grinding of ground surface 12, at approximately the same speed as machine 10, so that the material is conveyed by upper conveyor 18 and dropped into the box. The connection between upper conveyor 18 and frame 14 is discussed in further detail below, with reference to FIG. 2.

Machine 10 may also include one or more power sources (not shown) for powering material removal mechanism 15, upper conveyor 18, and/or various other components and systems of machine 10. For example, machine 10 may include one or more internal combustion engines, batteries, fuel cells, or the like for providing power. Machine 10 may also include various provisions for transmitting power from such power sources to material removal mechanism 15 and/or various other components of the machine. For example, where machine 10 includes an internal combustion engine as a power source, machine 10 may include one or more mechanical or electrical power-transmission devices, such as, mechanical transmissions, hydraulic pumps and motors, and/or electric generators and motors, for transmitting power from the engine to material removal mechanism 15 and upper conveyor 18.

Machine 10 may include a support system 20 and a steering system 22 to support machine 10 from ground surface 12 and steer machine 10 while moving along ground surface 12. Support system 20 may include one or more front ground-engaging components 24 and one or more rear ground-engaging components 26 configured to move along ground surface 12. FIG. 1 shows a front ground-engaging component 24 on a right side of machine 10, as well as a rear ground-engaging component 26 on the right side of machine 10. Machine 10 may include similar front and rear ground-engaging components 24, 26 on a left side. Each ground-engaging component 24, 26 may include any device or devices configured to move across ground surface 12, including but not limited to track units, wheels, and skids.

Support system 20 may include various components connecting frame 14 to ground engaging components 24, 26 in a manner to support machine 10 from ground engaging components 24, 26. As FIG. 1 shows, the components connecting front ground-engaging component 24 to frame 14 may include an undercarriage bracket 28 connected to ground engaging component 24, and a strut 30 connected to and extending up from undercarriage bracket 28. Strut 30 may be engaged to frame 14 directly or through one or more other components (not shown) in a manner allowing a front portion of machine 10 to be supported by strut 30.

The engagement between strut 30 and frame 14 may be such that it allows rotation of strut 30, undercarriage bracket 28, and ground-engaging component 24 about a vertical axis 34 relative to frame 14. This rotation capability may allow steering of ground-engaging component 24 and, thus, machine 10. Steering system 22 may have one or more actuators (not shown) for controlling the rotation of strut 30, undercarriage bracket 28, and ground-engaging component 24 about vertical axis 34.

Similar to the components connecting front ground-engaging component 24 to frame 14, support system 20 may include an undercarriage bracket 38 and a strut 40 supported from rear ground-engaging component 26. Strut 40 may be engaged to frame 14 directly or through one or more other components (not shown) in a manner allowing a rear portion of machine 10 to be supported by strut 40.

The engagement between strut 40 and frame 14 may be such that it allows rotation of strut 40, undercarriage bracket 38, and ground-engaging component 26 about a vertical axis 44 relative to frame 14. This rotation capability may allow steering of ground-engaging component 26, and, thus, machine 10. Steering system 22 may have one or more actuators (not shown) for controlling the rotation of strut 40, undercarriage bracket 38, and ground-engaging component 26 about vertical axis 44.

Machine 10 may include various components for controlling a lateral position and/or a steering angle of ground-engaging component 24 and/or ground engaging component 26. To receive operator inputs regarding a desired position and/or steering angle of one or both of the ground-engaging components, machine 10 may include one or more operator-input devices. For example, as FIG. 1 shows, steering system 22 may include a steering input 46 (such as a steering wheel, joystick, or other mechanism) that an operator may manipulate to signal desired steering changes. Similarly, steering system 22 may include an operator-input device (not shown) with which an operator may request inward or outward lateral movement, for example, of one or both of ground-engaging component 24, 26.

In addition to the components and systems mentioned above, machine 10 may have various other components and systems. For example, machine 10 may include a propulsion system for moving it along ground surface 12. In some embodiments, such a propulsion system may include one or more components for driving ground-engaging components 24, 26 to propel machine 10. For instance, where machine 10 includes a hydraulic pump (not shown) driven by a power source (not shown), machine 10 may include one or more hydraulic motors (not shown) drivingly connected to ground-engaging components 24, 26 to propel machine 10.

Figure 2:
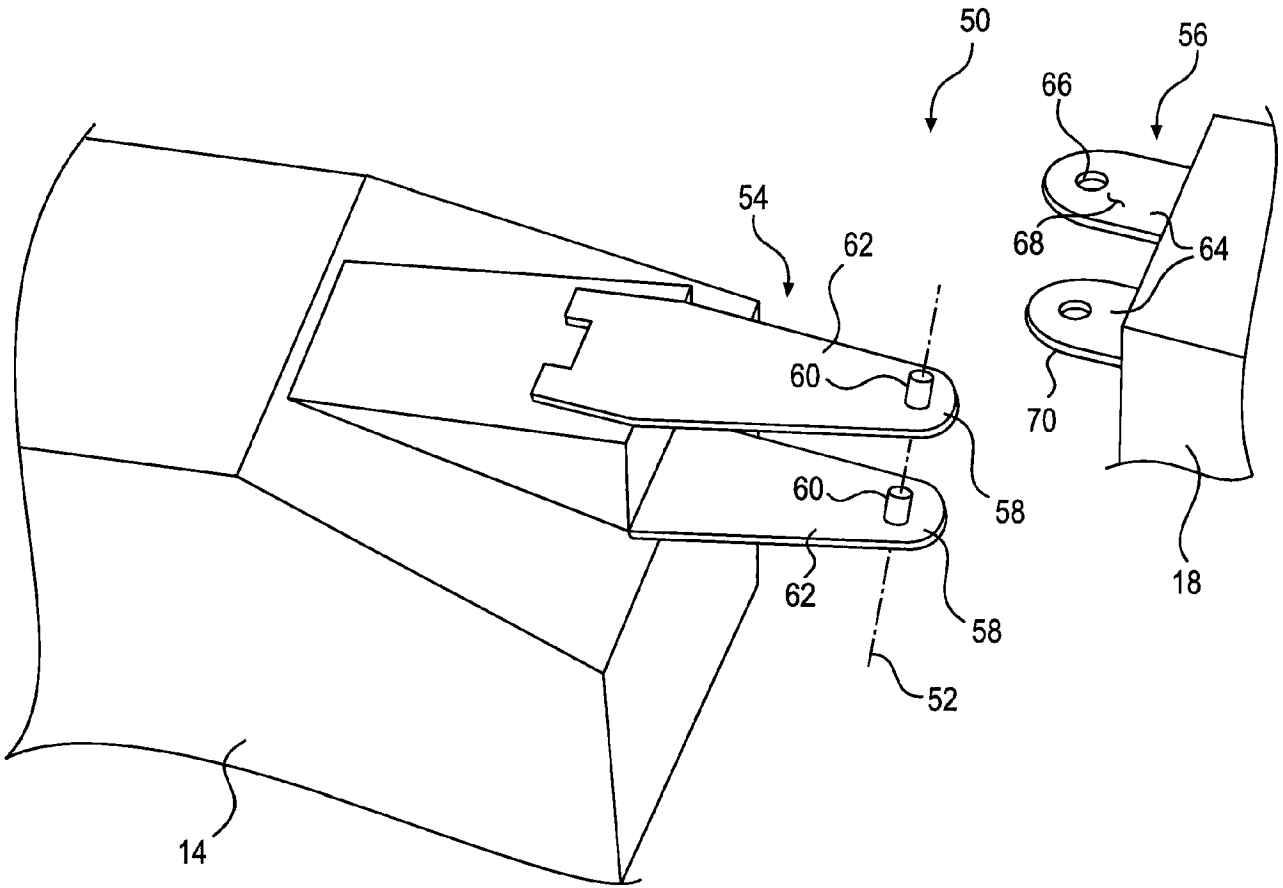
FIG. 2 is an exploded isometric detail view of the pivotal connection shown in FIG. 1.

FIG. 2 shows further details of a pivotal connection 50 between frame 14 and upper conveyor 18. Pivotal connection 50 may connect upper conveyor 18 with frame 14, and may permit rotation of upper conveyor 18 relative to frame 14, about a vertical axis 52. Machine 10 may include one or more actuators, motors, or any other components for controlling rotation of upper conveyor 18 about vertical axis 52. By this arrangement, upper conveyor 18 may be positioned so that the material removed from ground surface 12 and conveyed by upper conveyor 18 may be efficiently delivered, for example, to the box of a dump truck that is disposed proximate an end of upper conveyor 18.

Pivotal connection 50 may include a frame-side structure 54 and a conveyor-side structure 56 that cooperatively connect with one another. Frame-side structure 54 may be connected to frame 14, either directly or indirectly with additional components between frame-side structure 54 and frame 14. Frame-side structure 54 may include at least one frame-side flange 58, which may be bolted, welded, or otherwise attached, again either directly or indirectly, to frame 14. Flange 58 may extend approximately horizontally from frame 14 when machine 10 is located on a horizontal surface. Although FIG. 2 shows flange 58 including a portion having a particular shape and being a relatively flat plate, flange 58 is not limited to this shape. For example, flange 58 may include one or more portions having a square, rectangular, triangular, or any other desired shape, and flange 58 need not be a flat plate.

Flange 58 may include a connector 60 extending therefrom that cooperates with a corresponding connector (described below) on conveyor-side structure 56. Connector 60 may be, for example, a protrusion that extends approximately perpendicularly from a top surface 62 of flange 58. As shown in the drawings, the protrusion may be cylindrically shaped and may have an approximately circular cross-section. However, connector 60 may have any desired shape. Connector 60 may be connected to flange 58, either permanently such as by welding, or temporarily with the use of bolts or other fasteners. Alternately, connector 60 may be formed when flange 58 is formed, such as through material removal operations that result in connector 60 being unitary and integral with flange 58.

Conveyor-side structure 56 may be connected to upper conveyor 18, either directly or indirectly with additional components between conveyor-side structure 58 and upper conveyor 18. Conveyor-side structure 56 may include at least one conveyor-side flange 64, which may be bolted, welded, or otherwise attached, again either directly or indirectly, to an end of upper conveyor 18. Flange 64 may extend approximately horizontally from upper conveyor 18 when upper conveyor 18 is connected to frame 14 and machine 10 is located on a horizontal surface. Although FIG. 2 shows flange 64 including a portion having a particular shape and being a relatively flat plate, flange 64 is not limited to this shape. For example, flange 64 may include one or more portions having a square, rectangular, triangular, or any other desired shape, and flange 64 need not be a flat plate.

Flange 64 may include a connector 66 that cooperates with connector 60 of frame-side structure 54. Connector 66 may be, for example, an opening or hole with an axis that extends approximately perpendicularly between top and bottom surfaces 68 and 70 of flange 64. The hole may be sized, shaped, located, and/or otherwise oriented so that connector 60 is disposed within connector 66 and connectors 60, 66 mate with one another. Thus, when connector 60 is a cylindrically shaped protrusion with an approximately circular cross-section, connector 66 may be a hole having a corresponding approximately circular cross-section that is slightly larger than that of the protrusion. For example, the diameter of the hole forming connector 66 may between ½" to 1" greater than the diameter of the protrusion forming connector 60. Further, bottom surface 70 of flange 64 may contact top surface 62 of flange 58. As a result, when upper conveyor 18 is rotated relative to frame 14, connector 60 rotate within connector 66, and flange 64 rotates on top of flange 58. Although FIG. 2 shows the hole forming connector 66 as a through hole (i.e., a hole extending all the way through flange 64), the hole forming connector 66 may be a blind hole (i.e., a hole that does not extend all the way through flange 64). A bushing or other structure may be disposed within the hole.

FIG. 2 shows an exemplary pivotal connection 50 in which each of frame-side structure 54 and conveyor-side structure 56 includes two flanges (i.e., frame-side structure 54 includes two flanges 58, while conveyor-side structure 56 includes two flanges 64). However, each of these structures is not required to include two flanges. For example, pivotal connection 50 may include frame-side structure 54 and conveyor-side structure 56 each including a single flange (i.e., one flange 58 and one flange 64). Alternately, each of frame-side structure 54 and conveyor-side structure 56 may include three or more flanges.

Also, while FIG. 2 shows connector 60 being a protrusion and connector 66 being a hole that receives the protrusion, connectors 60, 66 are not required to be a protrusion and a hole, respectively. For example, connector 60 may be a hole while connector 66 may be a protrusion extending downwardly and sized to be disposed within the hole. Alternately, connectors 60 and 66 may be altogether different structures that are configured to cooperatively mate with one another to connect upper conveyor 18 to frame 14.

INDUSTRIAL APPLICABILITY

As described, the disclosure provides a pivotal connection that may be used between a frame and a conveyor in a cold planer. Specifically, the frame and conveyor may each include corresponding structures that permit connection of the conveyor to the frame as well as rotation of the conveyor relative to the frame after connection.

As disclosed, pivotal connection 50 may include frame-side structure 54 connected to frame 14, and conveyor-side structure 56 connected to upper conveyor 18. Frame-side structure 54 and conveyor-side structure 56 may include corresponding connectors that cooperatively connect and mate with one another, such that no additional or separate components (e.g., pins, fasteners, etc.) are required to rotatably connect upper conveyor 18 to frame 14.

As a result, assembly of upper conveyor 18 to frame 14 is greatly simplified as compared to the prior art. Specialized tooling is not required, for example, to hold and precisely position upper conveyor 18 relative to frame 14, since a pair of conventional mounting pins is not required to be inserted through corresponding sets of through holes that must be accurately aligned relative to each other. Instead, upper conveyor 18 can be suspended by a support structure, and upper conveyor 18 may be incrementally lowered while the protrusions on frame-side support structure 54 are aligned with the corresponding holes on conveyor-side support structure 56.

Further, removal of upper conveyor 18 from machine 10 is greatly simplified as compared to the prior art. A support structure may be used to lift upper conveyor 18 approximately vertically off of frame 14, without first requiring the removal of any pins or fasteners. Specialized tooling is not required to hold and precisely position upper conveyor 18 to prevent upper conveyor 18 from rotating relative to frame 14, which may bind pins or fasteners within through holes formed in these components. Thus, the use of the disclosed pivotal connection provides numerous advantages over similar conventional connections.

In accordance with the present disclosure, a conventional connection between a frame and an upper conveyor in a cold planer may be modified to form the above-discussed pivotal connection. For example, tooling may be used to hold the upper conveyor relative to the machine frame, so that the conventional pins or fasteners connecting the upper conveyor and the frame may be removed. The upper conveyor may then be moved away from the frame.

A protrusion may be formed in each of the holes of the flanges that are connected to the machine frame. For example, a bar of material having desired characteristics (material type, hardness, length, diameter, etc.) may be disposed in the flange hole. The material may then be permanently connected to the flange, such as by first placing the material in the hole, and then welding the material to the flange. Any desired final shaping of the protrusion may take place.

The existing hole in each of the flanges that are connected to the upper conveyor may be sized so that the protrusion may be received within the corresponding hole. The upper conveyor may then be suspended by a support structure, and the upper conveyor may be incrementally lowered, so that the protrusions formed on the machine frame flanges mate with the holes in the upper conveyor flanges.

After this modification, subsequent removal of the upper conveyor will no longer require the removal of separate pins or fasteners, but instead may be accomplished by lifting the upper conveyor approximately vertically off of the machine frame.

It will be apparent to those skilled in the art that various modifications and variations can be made to the disclosed machine. Other embodiments of the described machine will be apparent to those skilled in the art from consideration of the specification and practice of the machine disclosed herein. It is intended that the specification and examples be considered as exemplary only, with a true scope of the disclosure being indicated by the following claims and their equivalents.

What is claimed is:

1. A machine configured to travel across a surface, comprising:

a material removal mechanism configured to remove material from the surface a frame supporting the material removal mechanism;

a conveyor configured to receive the material and to convey the material to a location off of the machine; and a pivotal connection including connectors connected to the frame and conveyor, respectively, which are configured to mate with one another to allow pivoting of the conveyor relative to the frame;

wherein the pivotal connection includes a frame-side structure and a conveyor-side structure, and wherein the connectors include first and second cylindrically shaped protrusions and first and second approximately circular openings, the frame-side structure including the first cylindrically shaped protrusion that extends from a first frame-side flange connected to the frame, and including the second cylindrically shaped protrusion that extends from a second frame-side flange connected to the frame, and the conveyor-side structure including the first approximately circular opening formed in a first conveyor-side flange connected to the conveyor, and including the second approximately circular opening formed in a second conveyor-side flange connected to the conveyor, the first and second protrusions being disposed within the first and second openings.

2. The machine according to claim 1, wherein the pivotal connection includes a flange connected to the frame and a flange connected to the conveyor, and wherein the connectors include a protrusion and a hole, the protrusion extending from one of the flanges and configured to be disposed in the hole that is formed in the other flange.

3. The machine according to claim 1, wherein the pivotal connection includes a flange connected to the frame and a flange connected to the conveyor, and wherein the connectors include a protrusion and a hole, the flange connected to the frame including the protrusion that is configured to be disposed in the hole that is formed in the flange connected to the conveyor.

4. The machine according to claim 3, wherein the protrusion is cylindrically shaped, and a diameter of the hole is approximately ½" to 1" larger than a diameter of the protrusion.

5. The machine according to claim 1, wherein the pivotal connection includes two flanges connected to the frame and two flanges connected to the conveyor, and wherein the connectors include two protrusions and two holes, two of the flanges including the protrusions that are configured to be disposed in the holes formed in the other two flanges.

6. The machine according to claim 1, wherein the pivotal connection includes a frame-side structure and a conveyor-side structure, and wherein the connectors include a protrusion and an opening, the frame-side structure including the protrusion that extends from a frame-side flange connected to the frame, and the conveyor-side structure including the opening formed in a conveyor-side flange connected to the conveyor, the protrusion being disposed within the opening.

7. The machine according to claim 1, wherein a diameter of the first and second openings is approximately ½" to 1" larger than a diameter of the first and second cylindrically shaped protrusions.

8. The machine according to claim 1, wherein the material removal mechanism includes a grinding mechanism having a rotor with a plurality of teeth that are configured to grind a roadway surface.

9. The machine according to claim 1, wherein the first, and second openings are through holes extending through an entire thicknesses of the conveyor-side flanges.

10. The machine according to claim 1, wherein the first and second circular openings are blind holes that do not extend through entire thicknesses of the conveyor-side flanges.

11. A cold planer configured to remove material from a surface of a roadway, comprising:

a material removal mechanism configured to remove material from the surface;

a frame supporting the material removal mechanism;

a conveyor configured to receive the material and to convey the material to a location off of the cold planer; and a pivotal connection including a frame-side structure and a conveyor-side structure, the frame-side structure including at least one protrusion that extends from at least one frame-side flange connected to the frame, and the conveyor-side structure including at least one opening formed in at least one conveyor-side flange connected to the conveyor, the at least one protrusion configured to mate with the at least one opening to allow pivoting of the conveyor relative to the frame;

wherein the frame-side structure includes at least two protrusions extending from at least two frame-side flanges connected to the frame, wherein the conveyor-side structure includes at least two opening formed in at least two conveyor side flanges connected to the conveyor, and wherein the protrusions are disposed within the openings.

12. The cold planer according to claim 11, wherein the material removal mechanism includes a grinding mechanism having a rotor with a plurality of teeth that are configured to grind the roadway surface.

13. The cold planer according to claim 11, wherein the at least one cylindrically shape rid a diameter of the at least one opening is approximately ½" to 1" larger than a diameter of the at least one protrusion.

14. A cold planar configured to remove material from surface of a roadway, comprising:

a material removal mechanism including a grinding mechanism configured to remove material from the surface of the roadway;

a lower conveyor located adjacent the material removal mechanism and configured to receive the material removed from the surface of the roadway by the material removal mechanism;

a frame supporting the material removal mechanism and the lower conveyor;

an upper conveyor configured to receive the material from the lower conveyor and to further convey the material to a location off of the cold planer; and a pivotal connection including a first structure and a second structure, the first structure including first and second flanges connected to one of the frame and the upper conveyor, the first structure including first and second protrusions that extend from top surfaces of the first and second flanges, respectively, and the second structure including third and fourth flanges connected to the other one of the frame and the upper conveyor, the second structure including first and second openings formed in the third and fourth flanges, respectively, the first and second protrusions configured to mate with the first and second openings, respectively, to allow pivoting of the conveyor relative to the frame, and the first and second openings having diameters that are approximately ½" to 1" larger than corresponding diameters of the first and second protrusions, respectively.

15. The cold planer according to claim 14, wherein the first structure is connected to the frame, and the second structure is connected to the upper conveyor.

* * * * *

UNITED STATES PATENT AND TRADEMARK OFFICE

CERTIFICATE OF CORRECTION

PATENT NO. : 8,622,480 B2
APPLICATION NO. : 13/250850
DATED : January 7, 2014
INVENTOR(S) : Weckerly et al.

It is certified that error appears in the above-identified patent and that said Letters Patent is hereby corrected as shown below:

Title page

Delete Title page, and replace with new Title page. (attached)

Specification

Please correct the following as follows:

Column 2, line 32, delete "½" and insert -- ½" --.

Claims

Column 7, lines 28-30, in Claim 1, delete "a material removal mechanism configured to remove material from the surface a frame supporting the material removal mechanism;" and insert -- a material removal mechanism configured to remove material from the surface;
a frame supporting the material removal mechanism; --.

Column 7, lines 55-67 and Column 8, lines 1-21, below Claim 1, Claims 2-6 are deleted and renumber Claims 7-15 as Claims 2-10.

Column 8, line 30, in Claim 4, delete "the first, and" and insert -- the first and --.

Column 8, line 56, in Claim 6, delete "two opening" and insert -- two openings --.

Column 8, line 57, in Claim 6, delete "conveyor side" and insert -- conveyor-side --.

Column 8, lines 64-65, in Claim 8, delete "wherein the at least one cylindrically shape rid a diameter" and insert -- wherein the at least one protrusion is cylindrically shaped, and a diameter --.

Signed and Sealed this
First Day of December, 2015

Michelle K. Lee

Michelle K. Lee
*Director of the United States Patent and Trademark Office*

Claims

Column 9, lines 1-2, in Claim 9, delete "A cold planar configured to remove material from surface of a roadway, comprising:" and insert -- A cold planer configured to remove material from a surface of a roadway, comprising: --.

(12) United States Patent
Weckerly et al.

(10) Patent No.: US 8,622,480 B2
(45) Date of Patent: Jan. 7, 2014

(54) MACHINE WITH PIVOTAL CONNECTION BETWEEN A FRAME AND A CONVEYOR

(75) Inventors: Jordan Dorian Weckerly, Maple Grove, MN (US); Michael Edwin Stevens, Saint Paul, MN (US); Lucian Mihai Husar, Rogers, MN (US); John Eron Jorgensen, Andover, MN (US)

(73) Assignee: Caterpillar Inc., Peoria, IL (US)

( * ) Notice: Subject to any disclaimer, the term of this patent is extended or adjusted under 35 U.S.C. 154(b) by 161 days.

(21) Appl. No.: 13/250,850

(22) Filed: Sep. 30, 2011

(65) Prior Publication Data

US 2013/0082511 A1 Apr. 4, 2013

(51) Int. Cl.
*E01C 23/12* (2006.01)

(52) U.S. Cl.
USPC ..... 299/39.2; 198/313

(58) Field of Classification Search
USPC ..... 198/313, 315, 318, 861.5; 403/161–165; 299/39.2
See application file for complete search history.

(56) References Cited

U.S. PATENT DOCUMENTS

| | | | | |
|---|---|---|---|---|
| 2,561,997 | A * | 7/1951 | Smith | 198/861.5 |
| 3,049,817 | A * | 8/1962 | MacDonald | 37/381 |
| 3,591,935 | A * | 7/1971 | Bremmer et al. | 37/407 |
| 4,037,981 | A * | 7/1977 | Wirtgen | 299/39.2 |
| 4,325,580 | A | 4/1982 | Swisher, Jr. et al. | |
| 4,834,463 | A * | 5/1989 | Nye | 299/39.2 |
| 5,178,253 | A | 1/1993 | Fix | |
| 5,441,361 | A * | 8/1995 | Campbell | 404/90 |
| 7,527,279 | B1 | 5/2009 | McCalip | |
| 2005/0269114 | A1* | 12/2005 | Turgeon | 172/677 |

FOREIGN PATENT DOCUMENTS

| | | |
|---|---|---|
| JP | 02100402 | 8/1990 |
| KR | 10200901143 11 | 11/2009 |

OTHER PUBLICATIONS

"PM-200 Cold Planer," Caterpillar Inc., 2005, 16 pages.
"Technical specification: Cold Milling Machine W 200," Wirtgen Group, Mar. 2010, 8 pages.
"Technical specification: Cold Milling Machine W 210/W 210i," Wirtgen Group, Aug. 2011, 8 pages.
"Technical specification: Cold Milling Machine W 2100," Wirtgen Group, Mar. 2011, 8 pages.
"Technical specification: Cold Milling Machine W 2200," Wirtgen Group, Aug. 2009, 8 pages.

* cited by examiner

*Primary Examiner* — John Kreck
(74) *Attorney, Agent, or Firm* — Finnegan, Henderson, Farabow, Garrett & Dunner LLP

(57) ABSTRACT

A machine configured to travel across a surface is disclosed. A material removal mechanism is configured to remove material from the surface. A frame supports the material removal mechanism. A conveyor is configured to receive the material and to convey the material to a location off of the machine. A pivotal connection includes connectors connected to the frame and conveyor, respectively, which are configured to mate with one another to allow pivoting of the conveyor relative to the frame.

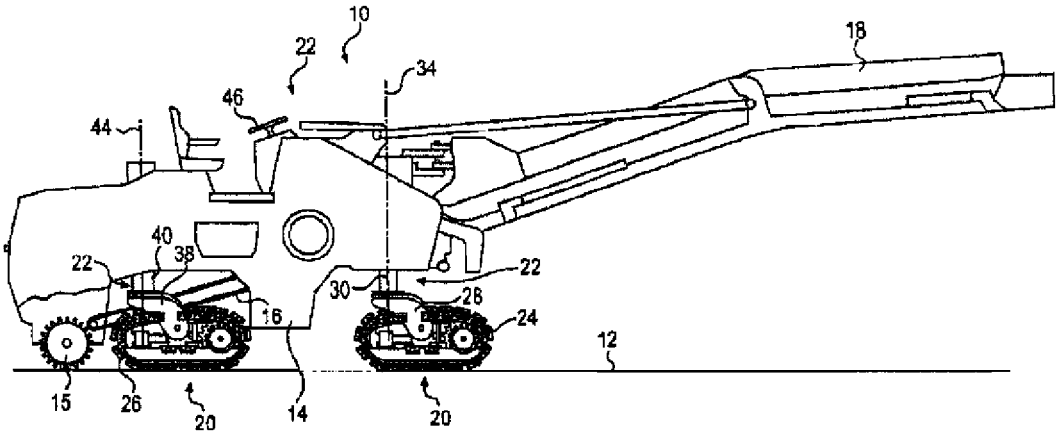

10 Claims, 2 Drawing Sheets